United States Patent [19]

Kaneko

[11] Patent Number: 4,759,206

[45] Date of Patent: Jul. 26, 1988

[54] METHOD AND APPARATUS FOR MANUFACTURING CURVED PIPE

[75] Inventor: Toshio Kaneko, Kanagawa, Japan

[73] Assignee: Kabushiki Kaisha Asahi Kinzoku Kogyosho, Kanagawa, Japan

[21] Appl. No.: 21,108

[22] Filed: Mar. 3, 1987

[51] Int. Cl.[4] ..... B21D 7/08; B21D 9/12

[52] U.S. Cl. ..... 72/134; 72/166; 72/369

[58] Field of Search ..... 72/133, 134, 166, 169, 72/369; 29/157 A

[56] References Cited

U.S. PATENT DOCUMENTS 4,352,281 10/1982 Ragettli ..... 72/133 X

FOREIGN PATENT DOCUMENTS 251492 11/1962 Australia ..... 72/133
53-146254 12/1978 Japan ..... 72/166
54-23677 8/1979 Japan .

*Primary Examiner*—E. Michael Combs
*Attorney, Agent, or Firm*—Flynn, Thiel, Boutell & Tanis

[57] ABSTRACT

A curved pipe manufacturing method comprising steps of inserting a mandrel attached to one side of a movable block so as to be inserted into and to be pulled out from a curved cavity of a circular arc formed in a fixed die and having an entrance and an exit into the curved cavity through the exit thereof, forming a curved pipe by pressing a work, namely, a straight pipe, with a pressing rod through the entrance of the curved cavity into a curved space defined by the surface of the curved cavity and the mandrel in the shape of a curved pipe to be manufactured, turning the movable block to retract the mandrel slightly relative to a curved portion of the work after pressing the work into the curved space by a predetermined length to mitigate the pressure of contact of the curved portion of the work with the mandrel, restarting pressing the work into the curved space to complete a curved pipe, turning the movable block to pull out the mandrel from the curved pipe formed in the curved space, and further turning the movable block to press the curved pipe with an ejecting rod attached to the other side of the movable block to eject the curved pipe out from the fixed die. An apparatus for carrying out the curved pipe manufacturing method is provided.

6 Claims, 3 Drawing Sheets

METHOD AND APPARATUS FOR MANUFACTURING CURVED PIPE

BACKGROUND OF THE INVENTION

1. Field of the Invention

The present invention relates to a curved pipe manufacturing method and an apparatus for carrying out the same and, more specifically, to a curved pipe manufacturing method and an apparatus for carrying out the same, in which a straight pipe of a stainless steel or like materias is pressed into a fixed die having a curved cavity of a circular arc to form a curved pipe.

2. Description of the Prior Art

Japanese Pat. Publication No. 54-23677 discloses a curved pipe manufacturing method employing an apparatus as illustrated in FIG. 4, invented by the inventor of the present invention. According to this known curved pipe manufacturing method, a work, namely, a straight pipe 5, is pressed with a presser rod into a curved space conforming to the shape of a curved pipe to be formed, defined by a curved cavity 4 formed in a fixed die 1 so as to extend from the entrance to the exit of the fixed die 1, and a curved mandrel 7 secured to a movable block 6 so as to be inserted into and to be pulled out from the curved cavity 4 and inserted into the curved hole 4 of the fixed die 1, through the entrance of the fixed die 1 to form a curved pipe, then the movable block 6 is turned to pull out the mandrel 7 from the fixed die 1, and then the movable block 6 is turned further to punch out the curved pipe from the fixed die 1 with an ejecting rod 8 attached to the movable block 6 opposite to the mandrel 7.

This known curved pipe manufacturing method, however, has a drawback in that, since the mandrel 7 is seized firmly by the curved pipe, the curved pipe is pulled out with the mandrel 7 instead of being ejected separately with the ejecting rod 8 when the mandrel 7 is pulled out from the fixed die 1 by turning the movable block 6, and hence the curved pipe needs to be removed from the mandrel 7 by some additional means. Accordingly, this known curved pipe manufacturing method is not able to automate the curved pipe manufacturing process.

SUMMARY OF THE INVENTION

Accordingly, an object of the present invention is to provide a curved pipe manufacturing method and an apparatus for carrying out the same eliminated of the forementioned drawback of the known curved pipe manufacturing method and capable of automating the curved pipe manufacturing process.

According to the curved pipe manufacturing method of the present invention, during a curved pipe forming process, a mandrel is moved slightly relative to a curved pipe being formed before the mandrel is seized firmly by the curved pipe, to diminish the pressure of contact of the curved pipe with the mandrel so that the pressure of contact of the curved pipe with the mandrel at the completion of forming the curved pipe is on a level that allows the extraction of the mandrel from the curved pipe. Thus, the pressing operation of a presser bar for pressng a straight pipe into a curved space conforming to the shape of curved pipe to be formed and formed in a fixed die is interrupted temporarily before the straight pipe is pressed into the curved space completely, then the mandrel is moved slightly toward the exit of the fixed die, and then the pressing operation of the presser bar is restarted to complete forming the curved pipe.

DESCRIPTION OF THE PREFERRED EMBODIMENT

Figure 1:
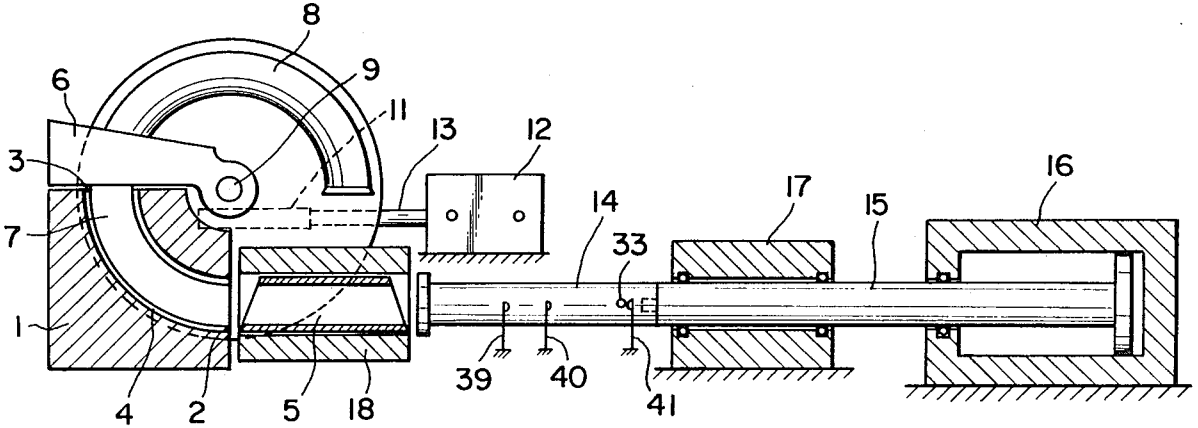
FIG. 1 is a sectional side elevation of a curved pipe manufacturing apparatus, in a preferred embodiment, for carrying out a curved pipe manufacturing method according to the present invention.

A curved pipe manufacturing apparatus, in a preferred embodiment, according to the present invention will be described with reference to FIGS. 1 to 3.

A fixed die 1 has a curved cavity 4 of a circular arc having an entrance 2 and an exit 3. The edge of the entrance 2 is rounded to faciliate pressing a work 5, namely, a straight pipe, into the curved cavity 4. A movable block 6 is provided with a mandrel 7 on one side thereof and an ejecting rod 8 on the other side thereof. The curved cavity 4, the mandrel 7 and the ejecting rod 8 are concentric. The movable block 6 is fixed to a rotary shaft 9. The diameter of the mandrel 7 is slightly smaller than the inside diameter of the work 5, while the diameter of the free end of the ejecting rod 8 is practically the same as the outside diameter of the work 5. The diameter of the curved cavity 4 is slightly greater than the outside diameter of the work 5.

Secured to one end of the rotary shaft 9 in a pinion 10 engaging a rack 11 joined to the free end of the piston rod 13 of a power cylinder 12.

A presser rod 14 for pressing the work 5 into the curved space formed between the surface of the curved cavity 4 of the fixed die 1 and the mandrel 7 has one end screwed in the free end of the piston rod 15 of a power cylinder 16. The presser rod 14 is operated by the power cylinder 16. The diameter of the other end, i.e., the free end, of the presser rod 14 is substantially the same as the outside diameter of the work 5. A guide member 17 is disposed near the front end of the power cylinder 16 to support and guide the piston rod 15. The free end of the piston rod 15 extends beyond the guide member 17 on the side of the fixed die 1.

A movable pipe supporting member 18 is disposed in front of the entrance 2 of the fixed die 1 so as to be moved toward and away from the entrance 2 of the fixed die 1 by the piston rod 20 of a power cylinder 19. The movable supporting member 18 is separated from the entrance 2 of the fixed die 1 and is located at a receiving position indicated by imaginary lines in FIG. 2, where the work 5 is supplied into the movable supporting member 18.

Pressurized working fluid supply/return tubes 21 and 22, 23 and 24, and 25 and 26 are connected to the power cylinders 12, 16 and 19, respectively. The pressurized working fluid supply/return tubes 21 and 22, 23 and 24, and 25 and 26 are connected through selector valves 27, 28, and 29, respectively, to a pressure generating machine such as an air compressor 30.

Projections 31, 32, and 33 are provided on the piston rods 13 and 20, and the presser rod 14, respectively. The projection 31 actuates sensors 34, 35 and 36; the projection 32 actuates sensors 37 and 38; the projection 33 actuates sensors 39, 40 and 41. When actuated, the sensors sends signals to a controller 42, and then the controller 42 controls the selector valves 27, 28 and 29 to control the operations of the power cylinders 13, 16 and 19 according to the signals given thereto.

Figure 2:
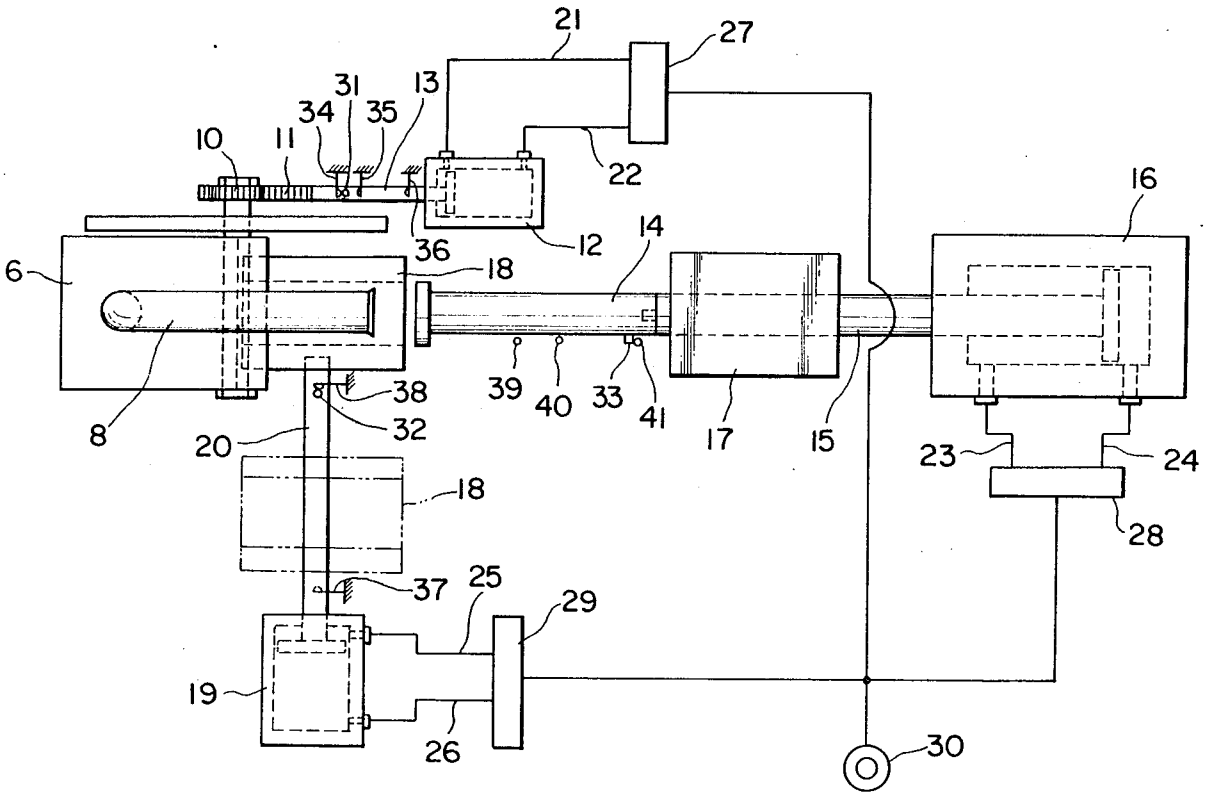
FIG. 2 is a plan view of the curved pipe manufacturing apparatus of FIG. 1.
Figure 3:
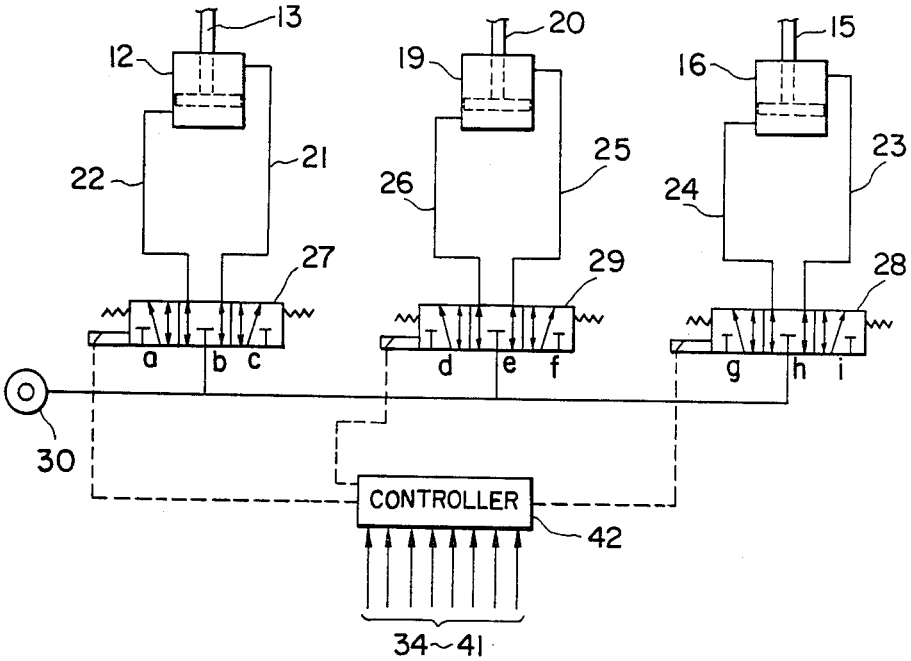
FIG. 3 is a circuit diagram of a controller for controlling the operation of the curved pipe manufacturing apparatus of FIG. 1.
Figure 4:
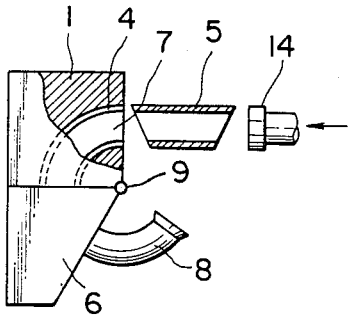
FIG. 4 (PRIOR ART)
FIG. 4 is a sectional side elevation of a conventional curved pipe manufacturing apparatus.

When the movable supporting member 18 is located at the receiving position indicated by imaginary line in FIG. 2, where the movable supporting member 18 receives the work 5, the mandrel 7 is located in place in the curved cavity 4 of the fixed die 1.

When actuated, the sensor 34 gives a signal to set the selector valve 27 at a position b, and the selector valve 29 at a position d to the controller 42. Consequently, supply of the working fluid to the power cylinder 12 is interrupted to interrupt the advancing motion of the piston rod 13; the working fluid is supplied through the tube 26 into the rear chamber of the power cylinder 19; the working fluid is discharged through the tube 25 from the front chamber of the power cylinder 19 to advance the piston rod 20 to move the movable supporting member 18 supporting the work 5 to a position immediately before the entrance 2 of the fixed die 1, where the projection 32 of the piston rod 20 actuates the sensor 38. Then, the sensor 38 gives a signal to the controller 42 and thereby the controller 42 sets the selector valve 29 at a postion e, and the selector valve 28 at a position g. Consequently, supply of the working fluid to the power cylinder 19 is interrupted to interrupt the advancing motion of the piston rod 20; the working fluid is supplied through the tube 24 into the rear chamber of the power cylinder 16 and the working fluid is discharged from the front chamber of the power cylinder 16 through the tube 23 to advance the piston rod 15, and thereby the work 5 supported on the movable supporting member 18 is pressed into the curved space formed between the inner surface of the fixed die 1 and the mandrel 7 through the entrance 2.

As the work 5 is pressed into the fixed die 1 by the presser rod 14, the work 5 is bent gradually in a circular arc increasing the pressure of contact of the bent portion of the work 5 with the mandrel 7 in proportion to the length of the bent portion of the work in contact with the mandrel 7. After the work 5 has been pressed into the fixed die 1 by 60 to 80% of the entire length thereof, the projection 33 of the presser rod 14 actuates the sensor 40. Then, the sensor 33 gives a signal to the controller 42 to set the selector valve 27 at a position c and the selector valve 28 at a position h. Consequently, supply of the working fluid to the power cylinder 16 is interrupted to interrupt the advancing motion of the piston rod 15 and the presser rod 14 temporarily; the working fluid is supplied through the tube 21 to the front chamber of the power cylinder 12 and the rear chamber of the power cylinder 12 is exhausted through the tube 22 to retract the piston rod 13 slightly, whereby the rotary shaft 9 is turned through a small angle by the rack 11 engaging the pinion 10 in a direction for turning the movable block 6 away from the fixed die 1. Thus, the mandrel 7 is released from the seizure of the bent portion of the work 5. When the piston rod 13 is retracted slightly, the projection 31 actuates the sensor 35. Then, the sensor 35 gives a signal to set the selector valve 27 at the position b and the selector valve 28 again to the positon g to the controller 42. Consequently, supply of the working fluid to the power cylinder 12 is interrupted to interrupt the retraction of the piston rod 13; the working fluid is supplied through the tube 24 into the rear chamber of the power cylinder 16 and the front chamber of the power cylinder 16 is exhausted through the tube 23 to advance the piston rod 15 again, whereby the work 5 is pressed further into the curved space formed between the inner surface of the curved cavity 4 of the fixed die 1 and the mandrel 7 with the presser rod 14.

Upon completion of the straight pipe bending process by advancing the piston rod 15 and the presser rod 14 further to press the work 5 entirely into the fixed die 1, the projetion 33 actuates the sensor 39. Then, the sensor 39 gives a signal to set the selector valve 28 at a position i to the controller 42. Consequently, the working fluid is supplied into the front chamber of the power cylinder 16 through the tube 23 and the rear chamber of the power cylinder 16 is exhausted through the tube 24 to retract the piston rod 15, so that the presser rod 14 is returned to a position separated from the fixed die 1. During the return movement of the presser rod 14, the projection 33 of the presser rod 14 engages the sensor 40. However, the sensor 40 is not actuated and the retraction of the presser rod 14 is continued until the projection 33 actuates the sensor 41. Then, the sensor 41 gives a signal to set the selector valve 28 at a position h and the the selector valve 29 at a position f to the controller 42. Consequently, supply of the working fluid to the power cylinder 16 is interrupted to stop the retraction of the piston rod 15; the working fluid is supplied through the tube 25 into the front chamber of the power cylinder 19 and the rear chamber of the power cylinder 19 is exhausted through the tube 26 to retract the piston rod 20, so that the movable block 18 is returned to the initial position. Upon the actuation of the sensor 37 by the projection 32 of the piston rod 20 during the retraction of the piston rod 20, the sensor 37 gives a signal to set the selector valve 27 at the position c and the selector valve 29 at the position e to the controller 42. Consequently, supply of the working fluid fluid to the power cylinder 19 is interrupted to stop the retraction of the piston rod 20; the working fluid is supplied through the tube 21 to the front chamber of the power cylinder 12 and the rear chamber of the power cylinder 12 is exhausted through the tube 22, so that the rotary shaft 9 is turned with the rack 11 engaging the pinion 10, whereby the movable block 6 is turned away from the fixed die 1. As the movable block 6 is turned, the mandrel 7 is pulled out from the curved pipe remaining within the fixed die 1, while the ejecting rod 8 attached to the other side of the movable block 6 is inserted through the entrance 2 of the curved cavity 4 into the fixed die 1 to eject the curved pipe out from the fixed die 1 by pushing the curved pipe at the rear end thereof. When the piston rod 13 is retracted further thus to turn the movable block 6, the projection 31 actuates the sensor 36 upon the ejection of the curved pipe from the fixed die 1. Then, the sensor 36 gives a signal to set the selector valve 27 at a position a to the controller 42. Consequently, the working fluid is supplied through the tube 22 into the rear chamber of the power cylinder 12 and the front chamber of the power cylinder 12 is exhausted through the tube 21 to advance the piston rod 13, whereby the rotary shaft 9 is turned with the rack 11 engaging the pinion 10 to turn the movable block 6 toward the fixed die 1. Thus, the ejecting rod 8 is pulled out from the curved cavity 4, and the mandrel 7 is inserted into the curved cavity 4 of the fixed die 1. During the advancing movement of the piston rod 13, the projection 31 engages the sensor 35. However, the sensor is not actuated and the piston rod 13 continues advancing to insert the mandrel 7 into the curved cavity 4.

Upon the complete insertion of the mandrel 7 into the curved cavity 4, the projection 31 actuates the sensor 34. Then, the sensor 34 gives a signal to set the selector valve 27 at the postion b and the selector valve 29 at the position d to the controller 42. Consequently, supply of the working fluid to the power cylinder 12 is interrupted to stop the advancing movement of the piston rod 13; the working fluid is supplied through the tube 26 into the rear chamber of the power cylinder 19, and the front chamber of the power cylinder 19 is exhausted through the tube 25 to advance the piston rod 20, whereby the movable pipe supporting member 18 is moved toward the fixed die 1.

A series of the foregoing actions is repeated to repeat the pipe bending process automatically. The movable pipe supporting member 18 receives the next work 5 at the position indicated by imaginary lines in FIG. 2, where the movable pipe supporting member 18 is separated from the fixed die 1.

To subject a work 5 having different outside diameter and inside diameter to the pipe bending process, another mandrel 7 having a diameter corresponding to the inside diameter of the work 5 and another ejecting rod 8 having a diameter corresponding to the outside diameter of the work 5 are attached to the movable block 6; the fixed die 1 is replaced by another fixed die 1 having a curved cavity 4 corresponding to the external shape of a curved pipe to be formed; another presser rod 14 having a diameter corresponding to the outside diameter of the work 5 is screwed in the free end of the piston rod 15; another movable pipe supporting member 18 suitable for supporting the new work 5 is connected to the piston rod 20.

The working fluid may be a hydraulic oil or compressed air. The pressure generating machine is an oil pump or an air compressor.

Although the present invention has been described as applied to a horizontal curved pipe manufacturing apparatus, the present invention is not limited thereto in its application, the present invention is applicable also to a vertical curved pipe manufacturing apparatus.

As apparent from the foregoing description, according to the present invention, the mandrel is retracted slightly relative to the work being bent during the pipe bending process to mitigate the pressure of contact of the work with the mandrel, the pressure of contact of the work with the mandrel at the completion of the pipe bending process is not as large as to make removal of the mandrel from the work difficult and hence the mandrel can be easily extracted form the work, so that the curved pipe manufacturing process employing the curved pipe manufacturing apparatus of the present invention can be automated, and the efficiency of the curved pipe manufacturing process is improved remarkably.

Furthermore, application of a lubricant to the external and internal surfaces of the work further diminishes the friction between the work and the mandrel and between the work and the surface of the curved cavity, and thereby the extraction of the mandrel from the work is further facilitated.

Still further, the disposition of the movable pipe supporting member at the entrance of the curved cavity of the fixed die facilitates supplying a work and ensures pressing the work into the fixed die with the presser rod.

Although the invention has been described in its preferred form with a certain degree of particularity, it is to be understood that many changes and variations are possible in the present invention without departing from the scope and spirit thereof.

What is claimed is:

1. A curved pipe manufacturing method comprising the steps of:

(1) inserting a curved mandrel into a curved cavity of a fixed die having an entrance opening and an exit opening, said curved mandrel being inserted into said curved cavity through said exit opening and attached to one side of a movable block;

(2) forming a curved pipe by pressing a work, with a presser rod through the entrance opening of the curved cavity into a curved space defined by the surface of the curved cavity and the mandrel (3) turning the movable block after completely forming the curved pipe so as to extract the mandrel from the fixed die;

(4) further turning the movable block to eject the curved pipe out from the fixed die by inserting an ejecting rod, attached to a side of the movable block opposite to the side to which the mandrel is attached, into the entrance opening of the curved cavity of the fixed die to push out the curved pipe with the ejecting rod; and (5) interrupting the action of the presser rod in pressing the work into the curved space and slightly removing the mandrel from a curved portion of the work and then restarting the advancement of the presser rod to press the work further into the curved space to complete the curved pipe.

2. A curved pipe manufacturing method as recited in claim 1, further comprising the step of applying a lubricant to the external and internal surfaces of the work prior to subjecting the work to the curved pipe forming process.

3. A curved pipe manufacturing apparatus comprising:

a fixed die having a curved cavity with an entrance opening an an exit opening;

a mandrel formed into a shape capable of being inserted into the curved cavity of the fixed die through the exit opening thereof and form a curved space corresponding to the shape of a curved pipe to be formed in the curved cavity;

a presser rod for pressing a straight pipe into the curved space to form a curved pipe;

an ejecting rod formed in a shape capable of being inserted into and removed from the entrance opening of the curved cavity to eject a curved pipe from the fixed die;

a movable block having the mandrel and the ejecting rod concentrically mounted on opposite sides thereof, said movable block being supported on a rotary shaft which inserts the mandrel into and removes the mandrel from the exit opening of the curved cavity and inserts the ejecting rod into and removes the ejecting rod from the entrance opening of the curved cavity; and a controller means for controlling driving mechanisms to temporarily interrupt the advancing motion of the presser rod after a sensor has detected that the presser rod has advanced a predetermined distance, to slightly remove the mandrel from a curved portion of the work, to restart the advancing motion of the presser rod to further press the work into the curved space and, after the curved pipe has been formed completely, to turn the movable block for removing the mandrel from the exit opening of the curved cavity and to insert the ejecting rod into the entrance opening of the curved cavity for ejecting the formed pipe from the fixed die.

4. A curved pipe manufacturing apparatus as recited in claim 3, further comprising a movable work supporting member disposed in front of the entrance opening of the curved cavity of said fixed die so as to support and guide a work when the work is pressed into the fixed die with said presser rod.

5. A curved pipe manufacturing apparatus as recited in claim 3, wherein said driving mechanisms are pneumatic motors and linkages connecting the pneumatic motors to the movable block and to the presser rod, respectively.

6. A curved pipe manufacturing apparatus as recited in claim 3, wherein said driving mechanisms are hydraulic motors and linkages connecting the hydraulic motors to the movable block and the presser rod, respectively.

* * * * *